United States Patent [19]

Noguchi et al.

[11] Patent Number: 4,518,673

[45] Date of Patent: May 21, 1985

[54] ELECTROPHOTOGRAPHIC DEVELOPER

[75] Inventors: Koji Noguchi, Saitama; Masumi Asanae, Kumagaya; Fumio Kimura, Isezaki, all of Japan

[73] Assignee: Hitachi Metals, Ltd., Tokyo, Japan

[21] Appl. No.: 488,647

[22] Filed: Apr. 26, 1983

[30] Foreign Application Priority Data

Apr. 28, 1982 [JP] Japan ..... 57-70523
May 12, 1982 [JP] Japan ..... 57-78402

[51] Int. Cl.[3] ..... G03G 9/08

[52] U.S. Cl. ..... 430/108; 430/106.6; 430/109; 430/110

[58] Field of Search ..... 430/106.6, 109, 110, 430/108

[56] References Cited

U.S. PATENT DOCUMENTS 2,891,011 6/1959 Insalaco ..... 430/109 X
4,265,993 5/1981 Kawanishi et al. ..... 430/109 X
4,288,519 9/1981 Diamond et al. ..... 430/110 X

FOREIGN PATENT DOCUMENTS 5090958 7/1980 Japan .
7060340 4/1982 Japan .
2070029A 9/1981 United Kingdom .

*Primary Examiner*—John E. Kittle
*Assistant Examiner*—Mukund J. Shah
*Attorney, Agent, or Firm*—Finnegan, Henderson, Farabow, Garrett & Dunner

[57] ABSTRACT

In a developer containing as toner at least a resin component and a coloring agent, when (A) a styrene-acrylic copolymer and (B) a polyester resin is used as the resin component and making the toner to have an electric resistance of $10^{13}$ Ω.cm or higher and a triboelectrification quantity of an absolute value of 5 μC/g or more, the resulting developer shows no offset phenomenon and gives excellent image quantity, transfer efficiency and good productivity.

10 Claims, No Drawings

ELECTROPHOTOGRAPHIC DEVELOPER

BACKGROUND OF THE INVENTION

This invention relates to an electrophotographic developer.

An electrophotographic process comprises forming an electrostatic latent image on the surface of a photosensitive material, developing the image by use of a binary developer which is a mixed powder of a toner of colored resin powder and a carrier such as iron powder by triboelectrically charging the carrier and the toner, and then transferring said toner to a transfer sheet, for example, by the application of an electric field.

In recent years, in place of the above-mentioned binary developer, magnetic toner comprising a resin, and a magnetic powder, as the main constituents, has also been employed. Development using the magnetic toner is known to be advantageous in that since no carrier is needed, it is sufficient to supplement a magnetic toner consumed, so that there is neither a mixing means for triboelectrification of a carrier, a toner or a means for obtaining a uniform toner concentration by supplementing a predetermined amount of toner consumed during the development is required. Thus the developing apparatus can be small-sized.

In addition to these plain paper copier (PPC) processes permitting copying using ordinary paper, there are known coated paper copier (CPC) processes by which direct recording is conducted by using photosensitive paper. However, in the case of the latter processes, although such apparatuses are inexpensive, expensive photosensitive paper is used, so that the running cost becomes very high as compared with that of the PPC processes, and, this has led to a decrease in the use of CPC processes in recent years.

As methods of fixing these developers, there are known, for example, pressure fixing by which fixing is conducted at ordinary temperatures by using a pressure roll, radiant heat fixing by use of a halogen lamp, a nichrome wire or the like as a heat source, and contact heat fixing by use of a heat roll.

Each of these methods has both merits and demerits. Pressure fixing has merit in that quick start is possible and the consumption of electricity is small, but is disadvantageous in that it is inferior in fixing properties to the heat fixing method. Radiant heat fixing is excellent in fixing properties but low in thermal efficiency and hence disadvantageous for high-speed fixing. On the other hand, heat roll fixing has merit in that although a little time is required before a condition in which fixing is possible is obtained after the apparatus is switched on, it is excellent in fixing properties and permits high-speed fixing. But, heat roll fixing is disadvantageous in that it tends to cause a so-called offset phenomenon, i.e. a toner adhering to the surface of a heat roll once, and then adhering to a transfer sheet again.

In order to cope with this, there have been proposed, for example, a developer comprising as resin components a copolymer selected from styrene-butadiene copolymers and vinyltoluene-butadiene copolymers and polyethylene wax, as disclosed in Japanese patent application Kokai (Laid-Open) No. 130,548/80, and a developer comprising as a resin component a mixture of a partly crosslinked styrene-butadiene copolymer resin having a high molecular weight and a hydrogenated rosin ester, as disclosed in Japanese patent application Kokai (Laid-Open) No. 153,945/80.

The present inventors discovered that in the case of the developer comprising as resin components a copolymer selected from styrene-butadiene copolymers and vinyltoluene-butadiene copolymers and polyethylene wax, an image free from the offset phenomenon could be obtained by means of a heat roll whose surface had been coated with Teflon (a trade name, E.I. du Pont de Nemours & Co.) but no image sufficiently excellent in quality could be obtained. It was also found that when prepared by a grinding method, the developer showed strong elastic deformation and was very poor in productivity. On the other hand, in the case of the toner comprising as a resin component a mixture of a partly crosslinked styrene-butadiene copolymer having a high molecular weight and a hydrogenated rosin ester, said toner becomes advantageous with respect to the offset phenomenon with an increase of the proportion of crosslinking but becomes greatly disadvantageous in productivity, like the above-mentioned proposal.

SUMMARY OF THE INVENTION

In view of these circumstances, this invention provides a developer which is excellent in productivity, good in the quality of image and in transfer efficiency, and advantageous with respect to the offset phenomenon.

That is to say, this invention provides a transferable electrophotographic developer comprising as main constituents at least a resin component and a coloring agent to give a toner, the improvement wherein (1) said resin component includes at least 10 to 80% by weight of a styrene-acrylic copolymer and 10 to 80% by weight of a polyester resin, and (2) said toner has an electric resistance of $10^{13}\Omega\cdot$cm or higher and a triboelectrification quantity of an absolute value of 5 $\mu$C/g ($|5|\mu$C/g) or more.

DESCRIPTION OF THE PREFERRED EMBODIMENTS

The present inventors have conducted considerable research on resins used in developers for heat roll fixing and found that a developer good both in productivity and in offset resistance can be obtained by the incorporation of at least a styrene-acrylic copolymer and a polyester resin as resin and an aliphatic resin as a releasing agent.

In detail, the above-mentioned resins themselves are well known, but a very good result could be obtained by combining these resins. That is to say, styrene-acrylic copolymers and polyester resins are, per se, excellent in the quality of image and in productivity but slightly poor in offset resistance. However, the incorporation of an aliphatic resin as a releasing agent into these resins improves the offset resistance and makes it possible to obtain a developer good in all offset resistance, the quality of image, and productivity.

The styrene-acrylic copolymers include various types depending on monomer compositions used. In this invention, the following can effectively be used: styrene-acrylic copolymers obtained from styrene monomer and one or more $\alpha$-methylene aliphatic monocarboxylic acid esters such as methyl acrylate, ethyl acrylate, n-butyl acrylate, isobutyl acrylate, n-octyl acrylate, 2-chloroethyl acrylate, phenyl acrylate, methyl $\alpha$-chloroacrylate, methyl methacrylate, n-butyl methacrylate, isobutyl methacrylate, $\beta$-hydroxyethyl methacrylate, glycidyl methacrylate, diethylaminoethyl methacrylate, etc. Particulary, styrene-acrylate copolymers and styrene-methacrylate copolymers are practically used. It is preferable to use a styrene-acrylic copolymer having a weight average molecular weight (Mw) of 50,000 to 300,000, more preferably 150,000 to 270,000, and a number average molecular weight (Mn) of 10,000 to 50,000, more preferably 25,000 to 35,000, Mw/Mn (a molecular weight distribution) of 3 to 30, more preferably 4 to 9 and a glass transition point (Tg) of 55° C. or higher.

As the polyester resin, it is preferable to use in this invention those having a Mw of 5,000 to 100,000, more preferably 50,000 or less and most preferably 15,000 to 30,000, an Mn of 5,000 to 20,000 and Mw/Mn of 5 to 20, more preferably 6 to 12, and Tg of 55° C. or higher. More concretely, bisphenol type polyester resins can be used effectively. Further, other polyester resins having a softening point of 80 to 150° C. can also be used. Particularly, polyester resins having a softening point of 110° to 130° C., more preferably 120° to 130° C. can effectively be used because of good fixing properties and resistance to the offset phenomenon. Concrete examples of such polyesters are PS #2 (manufactured by Hitachi Chemical Company, Ltd.; Tg 61.2° C., a softening point 120.5° C.), and those disclosed in Japanese patent appln. Kokoku (Post-Exam. Publn.) No. 10743/83.

As the releasing agent, there are known aliphatic series compounds such as aliphatic resins, metal salts of fatty acids, higher fatty acids, fatty acid esters and their partially saponified compounds. Among these compounds, aliphatic resins can be used effectively in this invention for preventing the offset phenomenon. Particularly, aliphatic resins having lower molecular weights are effective. More concretely, polyethylene and polypropylene (waxes) having an Mw of 1,000 to 10,000 are effective.

In this invention, a styrene-butadiene copolymer may be contained as a resin component in addition to the aforesaid resin components. Styrene-butadiene copolymers are excellent in offset resistance and hence effective in developers for heat roll fixing. However, the styrene-butadiene copolymers are disadvantageous in that no fine quality of image can be obtained and they are difficult to ground and hence low in productivity, but such a disadvantage can be removed by using them together with the above-mentioned resins. As the styrene-butadiene copolymers, there can preferably be used those having an Mw of 50,000 to 200,000, more preferably 100,000 to 150,000, an Mn of 10,000 to 30,000, more preferably 10,000 to 20,000, Mw/Mn of 2 to 20, more preferably 5 to 9 and a Tg of 50° C. or higher. More concretely, there can be used, for example, Pliolite S5A, S5B, S5D and S5E manufactured by Goodyear Tire and Rubber Co., S-225 and S-226 manufactured by Japanese Geon Co., and the like.

As materials for toners, there may be used, besides the resin components, charge control agents such as nigrosine type dyes, metal-containing dyes and the like, and coloring agents such as carbon black, aniline black and the like. In order to impart magnetism to the developer, there may be incorporated thereinto one or more kinds of magnetic powder (particle size: 0.1 to 3 μm, more preferably 0.3 to 1 μm), e.g., metals or their alloys such as magnetite, hexmatite, ferromagnetic ferrite, Ni, Cr and the like. In addition, fluid improvers such as silica, talc, alumina and the like may be added thereto. Among these materials for toners, carbon black is electrically conductive and hence can be used also as an agent for controlling electric resistance.

In preparing a developer by compounding the above-mentioned materials for toners, both the fixing properties and offset resistance can be improved when its melt viscosity at about 160° C. is adjusted so as to be in the range of 100 to 10,000 centipoises in consideration of fixing temperature, fixing pressure and the like.

The compounding amounts of the above-mentioned materials for toner are preferably as follows. First, the compounding ratio of the styrene-acrylic copolymer (A) to the polyester resin (B) is preferably (A):(B)=1:9 to 9:1 by weight, more preferably (A):(B)=2:8 to 8:2 by weight. Next, the releasing agent is preferably contained in an amount of 1 to 20% by weight based on the total amount of the resins. This is because when the content of the releasing agent is less than 1% by weight, the releasing effect is lessened, and when it exceeds 20% by weight, the powder characteristics and the development characteristics are lowered.

When a styrene-butadiene copolymer (C) is also incorporated as a resin component in addition to above (A) and (B), each of (A) to (C) is preferably incorporated in an amount of 10 to 80% by weight, more preferably 10 to 40% by weight, for (A) based on the total amount of the resin components, 10 to 80% by weight for (B), and 10 to 80% by weight for (C).

The resin components, as a whole, are preferably incorporated in an amount of 40% by weight or more based on the total amount of the resulting developer from the viewpoint of fixing properties. Further, when a developer is prepared as a binary toner used together with a carrier, it may contain up to 90% by weight of the resins. On the other hand, when a developer is prepared as a magnetic toner, the content of the resin components is preferably 20 to 60% by weight because in usual, 40 to 80% by weight of magnetic powder is incorporated, while the coloring agent content is 10% by weight or less.

Since the resins used in this invention are excellent in dispersibility in magnetic powder, a toner having high resistance and a low dielectric constant can be prepared, and said resins are very effective particularly when used in a magnetic toner.

As a process for preparing the toner, the process shown below is exemplified. Starting materials are melted, heated and then kneaded by conventional methods, thereafter cooled to be solidified, and then finely ground by means of a jet mill or the like. Subsequently, the thus obtained fine powder is passed in an atomized form through a heating furnace to carry out sphering treatment, and if necessary, a resistance-controlling agent and a charge controlling agent are firmly attached to the surface of the fine powder, whereby a toner having a predetermined particle size can be obtained.

The electric resistance of the thus obtained toner particles is adjusted to at least $10^{13}\Omega\cdot$cm. This is because when it is lower than $10^{13}\Omega\cdot$cm, the toner is disordered when transferred to a transfer sheet, so that the quantity of image is deteriorated. This influence is prominent particularly at a high humidity.

The electric resistance of the toner can be measured by putting the toner in a Teflon cylinder having a diameter of 3.05 mm so that the height of the toner may be about 10–20 mm when a load of 200 g is applied to the toner, and applying a voltage of 4,000 V/cm between electrodes.

The triboelectrification quantity of the present toner also is very important for the quantity of image and transfer efficiency. In this case, when a photosensitive material having a positive charge such as a selenium photosensitive material is subjected to normal development, the electric charge of the toner is preferably $-5$ $\mu C/g$ or less. When a photosensitive material having a negative charge such as zinc oxide, cadmium sulfide or organic photo-conductor (OPC) is subjected to normal development, the electric charge of the toner is preferably $+5\mu C/g$ or more.

The triboelectrification quantity of the toner can be measured by means of a commercially available flow-off machine for measuring electric charge (TB-200 manufactured by Toshiba Chemical K.K.) after the concentration of the toner is adjusted to 5% by weight based on a carrier (EFV 200/300 manufactured by Nihon Teppun K.K.) and the toner and the carrier are sufficiently mixed and stirred.

The electrophotographic developer of this invention can particularly effectively be used in the magnetic brush process, etc.

This invention is illustrated by way of the following Examples, in which all percents and parts are by weight unless otherwise specified.

EXAMPLE 1

TABLE 1

| | (unit: parts) | | | | | |
|---|---|---|---|---|---|---|
| Run. No. | No. 1 | No. 2 | No. 3 | No. 4 | No. 5 | No. 6 |
| Styrene-acrylic copolymer | 23 | 35 | 25 | 15 | 5 | 40 |
| Polyester resin | 20 | 5 | 15 | 25 | 35 | 0 |
| Polypropylene | 0 | 3 | 3 | 3 | 3 | 3 |
| Charge controlling agent | 2 | 2 | 2 | 2 | 2 | 2 |
| Magnetic powder | 55 | 55 | 55 | 55 | 55 | 55 |

By use of a bisphenol type polyester resin (number average molecular weight ($\overline{M}n$) 5,700, weight average molecular weioht ($\overline{M}w$) 63,000, glass transition temperature (Tg) 67° C., softening point 123° C.), styrene-n-butyl methacrylate copolymer ($\overline{M}n$ 20,000, $\overline{M}w$ 220,000, Tg 60° C.), polypropylene (type Biscol 550P manufactured by Sanyo Chemical Industries, Ltd.), a charge controlling agent (Bontron E83 manufactured by Orient Kagaku, K.K.), and magnetite (EPT 1000 manufactured by Toda Industrial Co., Ltd.), six kinds of toners listed in above Table 1 were prepared according to the following preparation process. Physical properties of resins were measured as follows (see U.S. Pat. No. 4,265,993):

Tg: Using a thermomechanical analyzer (Model TMS-1, Perkin Elmer Co.)

Softening point: Ball and Ring Method (JIS K 2351-1960) $\overline{M}w$, $\overline{M}n$, $\overline{M}w/Mn$: Gel permeation chromatography First, the materials in each case were sufficiently kneaded together by means of a pressure kneader at a temperature of 140° C. for 20 minutes, cooled to be solidified, and finely ground by means of a jet mill. Subsequently, 0.6 part of finely divided silica was added to the thus obtained fine powder, and subjected to sufficient dry blending therewith at ordinary temperatures, after which the resulting mixture was passed in an atomized form through a hot air stream at 150° C. to carry out sphering treatment. Next, 0.5 part of finely divided silica was further added to the mixture and mixed therewith, after which there were obtained magnetic toner particles with a particle size adjusted to 5 to 20 $\mu m$.

The triboelectrification quantity of the thus obtained toner particles was $-5$ $\mu C/g$ or less in all the case and the electric resistance thereof was $10^{14}\Omega\cdot cm$ or higher in all the cases.

These toners were subjected to the evaluation of image by means of a copying machine having a selenium photosensitive material which had been obtained by altering a commercially available one. The development conditions were as follows. As the developing roller, a magnet roller having an outer diameter of 29.3 mm and having symmetric magnetic 12 poles (symmetrial magnetized in a stainless steel shell having an outer diameter of 1.4 mm and a magnetic flex density of 600 gauss on a shell, was used. The magnet roller and a sleeve were rotated at 1,200 r.p.m. and 100 r.p.m., respectively, so that each magnetic toner might be conveyed in the same direction as with the photosensitive material, and a gap between the photosensitive material and the sleeve was adjusted to 0.45 mm, and a gap between a doctor blade and the sleeve to 0.35 mm. As a result, No. 1 toner containing no polypropylene copolymer showed a good quality of image, but caused the offset phenomenon at a fixing rate of 100 mm/sec. in a Teflong heat roll fixing machine heated to 170° C.

No. 6 toner containing no bisphenol type polyester resin did not cause the offset phenomenon under the same fixing conditions as described above and showed good fixing properties, but gave no fully black image having a uniform density, and was insufficient in the stability of image density in continuous copying. Further, this toner was very inferior in grindability to the other toners.

On the other hand, in the case of the toners of Nos. 2 to 5, no offset phenomenon was caused and a very good image could be obtained.

As a comparative example, there was prepared, in the same manner as described above, a toner containing no charge controlling agent which consisted of 36 parts of a bisphenol type polyester resin, 7.5 parts of styrene-n-butyl methacrylate copolymer, 1.5 parts of polypropylene (Biscol 550P manufactured by Sanyo Chemical Industries, Ltd.) and 55 parts of magnetite (EPT 1000 manufactured by Toda Industrial Co., Ltd.). This toner was subjected to the evaluation of image, and as a result, no offset phenomenon took place, but the triboelectrification quantity was $-2.5$ $\mu C/g$ and no sufficient image density could be obtained.

Further, as another comparative example, magnetic toner particles having a particle size of 5 to 20 $\mu m$ were obtained by employing the same composition as No. 2 composition, except that 1.5 parts of carbon black (#30 manufactured by Mitsubishi Chemical Industries Ltd.) was added to the sphered powder, and carrying out treatment for fixing the carbon black in a hot air stream at 130° C. The electric resistance of this toner was $3\times10^{12}\Omega\cdot cm$, and only a blurred image with serious disorder of the toner could be obtained.

EXAMPLE 2

Starting materials consisting of 15 parts of the same bisphenol type polyester resin as used in Example 1, 25 parts of styrene-n-butyl methacrylate copolymer (see Example 1), 3 parts of a low molecular weight polyethylene (Wax C manufactured by Hoechst AG.), 2 parts of a positive charge controlling agent (Bontron AFP-B manufactured by Orient Chemical Co., Ltd.) and 55 parts of magnetite (KBC 100 manufactured by Kanto Denka Kogyo Co., Ltd.) were sufficiently kneaded together by means of a pressure kneader at a temperature of 135° C. for 15 minutes, cooled to be solidified, and finely ground by means of a jet mill.

Subsequently, 0.5% of a finely divided silica (R972 manufactured by Nihon Aerosil Co., Ltd.) was added to the thus obtained fine powder, and the resulting mixture was passed in an atomized form through a hot air stream at 100° C. to carry out sphering treatment, whereby toner particles having a diameter of 5 to 20 μm were obtained.

This toner had an electric resistance of $1\times10^{16}\Omega\cdot$cm and a triboelectrification quantity of +7.0 μC/g.

This toner was subjected to the evaluation of image by normal development by means of a copying machine using OPC photosensitive material with a negative charge, under the same development conditions as in Example 1. As a result, no offset phenomenon took place at a fixing rate of 100 mm/sec. in a Teflong heat roll fixing machine heated to 170° C., and a very distinct image could be obtained.

EXAMPLE 3

By use of starting materials of a styrene-butadiene copolymer (S5B manufactured by Goodyear Tire and Rubber Co.), a styrene-n-butyl methacrylate copolymer (number average molecular weight 20,000, weight average molecular weight 220,000, glass transition temperature 60° C.), a bisphenol type polyester resin (number average molecular weight 63,000, glass transition temperature 67° C., softening point 123° C.), polypropylene (Biscol 550P manufactured by Sanyo Chemical Industries, Ltd.), a charge controlling agent (Bontron ER3 manufactured by Orient Chemical Co., Ltd.) and magnetic powder (EPT 1000 manufactured by Toda Industrial Co., Ltd.), six kinds of toners listed in Table 2 were prepared according to the following preparation process.

TABLE 2

| | (unit: parts) | | | | | |
|---|---|---|---|---|---|---|
| Run No. | No. 7 | No. 8 | No. 9 | No. 10 | No. 11 | No. 12 |
| Styrene-butadiene copolymer | 0 | 5 | 10 | 5 | 5 | 20 |
| Styrene-acrylic copolymer | 20 | 15 | 15 | 30 | 5 | 0 |
| Polyester resin | 20 | 20 | 15 | 5 | 30 | 0 |
| Aliphatic resin | 3 | 3 | 3 | 3 | 3 | 3 |
| Charge controlling agent | 2 | 2 | 2 | 2 | 2 | 2 |
| Magnetic powder | 55 | 55 | 55 | 55 | 55 | 55 |

First, the materials in each case were sufficiently kneaded together by means of a pressure kneader at a temperature of 140° C. for 20 minutes, cooled to be solidified, and finely ground by means of a jet mill. Subsequently, 0.6 part of finely divided silica was added to the thus obtained fine powder, and subjected to sufficient dry blending therewith at ordinary temperatures, after which the resulting mixture was passed in an atomized form through a hot air stream at 150° C. to carry out sphering treatment. Next, 0.5 part of finely divided silica was further added to the mixture and mixed therewith, after which there were obtained magnetic toner particles with a particle size adjusted to 5 to 20 μm.

The triboelectrification quantity of the thus obtained toner particles was −5 μC/g or less in all the cases and the electric resistance thereof was $10^{14}\Omega\cdot$cm or higher in all the cases.

These toners were subjected to the evaluation of image under the same conditions as in Example 1 by means of a copying machine having a selenium photosensitive material which had been obtained by altering a commercially available one. As a result, No. 7 toner containing no styrene-butadiene copolymer showed a good quality of image, and the same offset resistance as Nos. 2 to 5 but inferior to Nos. 8 to 11 in the offset resistance.

No. 12 toner containing neither styrene-n-butyl methacrylate copolymer nor bisphenol type polyester resin did not cause the offset phenomenon under the same fixing conditions as described above and showed good fixing properties but gave no fully black image having a uniform density, and was insufficient in the stability of image density in continuous copying. Further, this toner was very inferior in grindability to the other toners.

On the other hand, in the case of the toners of Nos. 8 to 11, no offset phenomenon was caused and the offset resistance was better than Nos. 2 to 5, and also a very good image could be obtained.

As a comparative example, there was prepared, in the same manner as described above, a toner containing no charge control agent which consisted of 15 parts of styrene-n-butyl methacrylate copolymer (see Table 2), 15 parts of a bisphenol type polyester resin (see Table 2), 12 parts of a styrene-butadiene copolymer (S5B manufactured by Goodyear Tire and Rubber Co.), 3 parts of a polypropylene (Biscol 550P manufactured by Sanyo Chemical Industries, Ltd.), and 55 parts of magnetite (EPT 1000 manufactured by Toda Industrial Co., Ltd.). This toner was subjected to the evaluation of image, and as a result, no offset phenomenon took place, but the triboelectrification quantity was −2.5 μC/g and no sufficient image density could be obtained.

Further, as another comparative example, magnetic toner particles having a particle size of 5 to 20μ were obtained by employing the same composition as No. 8 composition except that 1.5 parts of carbon black (#30 manufactured by Mitsubishi Chemical Industries Ltd.) was added to the sphered powder, and carrying out treatment for fixing the carbon black in a hot air stream at 130° C. The electric resistance of this toner was $6\times10^{12}\Omega\cdot$cm, and only a blurred image with serious disorder of the toner could be obtained.

EXAMPLE 4

Starting materials consisting of 5 parts of the same bisphenol type polyester resin as used in Example 3, 5 parts of a styrene-butadiene copolymer resin (S-226 manufactured by Japanese Geon Co., Ltd.), 30 parts of styrene-n-butyl acrylate copolymer, 3 parts of a low molecular weight polyethylene (Wax C manufactured by Hoechst AG.), 2 parts of a positive change control agent (Bontron AFP-B manufactured by Orient Chemical Co., Ltd.), and 55 parts of magnetite (KBC 100 manufactured by Kanto Denka Kogyo Co., Ltd.) were sufficiently kneaded together by means of a pressure kneader at a temperature of 135° C. for 15 minutes, cooled to be solidified, and finely ground by means of a jet mill.

Subsequently, 0.5% of a finely divided silica (R972 manufactured by Nihon Aerosil Co., Ltd.) was added to the thus obtained fine powder, and the resulting mixture was passed in an atomized form through a hot air stream at 100° C. to carry out sphering treatment, whereby toner particles having a diameter of 5 to 20 μm were obtained. This toner had an electric resistance of $5\times10^{15}\Omega\cdot$cm and a triboelectrification quantity of +7.5 μC/g.

This toner was subjected to the evaluation of image by normal development by means of a copying machine using OPC photosensitive material with a negative charge, under the same development conditions as in Example 1. As a result, no offset phenomenon took place at a fixing rate of 100 mm/sec. in a Teflon heat roll fixing machine heated to 170° C., and a very distinct image could be obtained.

What is claimed is:

1. A transferable electrophotographic developer which includes a toner comprising a resin component and a coloring agent wherein (1) said resin component includes (A) 10 to 80% by weight of a styrene-acrylic copolymer and (B) 10 to 80% by weight of a polyester resin, and (2) said toner has an electric resistance of $10^{13}\Omega\cdot$cm or higher and a triboelectrification quantity of 5 μC/g or less or +5 μC/g or more.

2. A developer according to claim 1, wherein said resin component further includes (C) a styrene-butadiene copolymer.

3. A developer according to claim 1, wherein said resin component further includes an aliphatic resin as a releasing agent in an amount ranging from 1–20% by weight.

4. A developer according to claim 1, which further comprises a magnetic powder to give toner particles.

5. A developer according to claim 1, wherein the weight ratio of (A)/(B) is 1/9 to 9/1.

6. A developer according claim 2, wherein the proportion of (A) is 10 to 80% by weight, (B) is 10 to 80% by weight and (C) is 10 to 80% by weight.

7. A developer according to claim 4, wherein the content of magnetic powder is 40 to 80% by weight.

8. A developer according to claim 1, wherein the styrene-acrylic copolymer (A) is a copolymer of styrene and acrylate or a copolymer of styrene and methacrylate.

9. A developer according to claim 1, wherein the polyester resin (B) is a polyester resin obtained from bisphenol.

10. A developer according to claim 2, wherein said (C) styrene-butadiene component is present in an amount ranging from 25% or less by weight based on the total weight of (A), (B), and (C).

* * * * *